US008447221B2

(12) United States Patent
Hasegawa

(10) Patent No.: US 8,447,221 B2
(45) Date of Patent: May 21, 2013

(54) FIXING DEVICE AND IMAGE FORMING APPARATUS INCORPORATING SAME

(75) Inventor: Kenichi Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/430,234

(22) Filed: Mar. 26, 2012

(65) Prior Publication Data

US 2012/0251208 A1 Oct. 4, 2012

(30) Foreign Application Priority Data

Apr. 4, 2011 (JP) ..... 2011-082385
May 18, 2011 (JP) ..... 2011-111550

(51) Int. Cl.
*G03G 15/20* (2006.01)

(52) U.S. Cl.
USPC ..... 399/329

(58) Field of Classification Search
USPC ..... 399/320, 329
See application file for complete search history.

(56) References Cited

U.S. PATENT DOCUMENTS

| | | | |
|---|---|---|---|
| 5,400,123 | A | 3/1995 | Sato et al. |
| 6,131,009 | A | 10/2000 | Hasegawa |
| 6,496,666 | B2 | 12/2002 | Hayashi et al. |
| 6,591,081 | B2 | 7/2003 | Hasegawa |
| 7,070,182 | B2 | 7/2006 | Hasegawa |
| 7,515,850 | B2 | 4/2009 | Hasegawa |
| 7,630,652 | B2 | 12/2009 | Hasegawa |
| 7,925,177 | B2 | 4/2011 | Ishii et al. |
| 8,064,798 | B2 | 11/2011 | Shinshi et al. |
| 2007/0014600 | A1 | 1/2007 | Ishii et al. |
| 2010/0092220 | A1 | 4/2010 | Hasegawa et al. |
| 2010/0202809 | A1 | 8/2010 | Shinshi et al. |
| 2010/0290822 | A1 | 11/2010 | Hasegawa et al. |
| 2011/0026987 | A1 | 2/2011 | Hasegawa |
| 2011/0026988 | A1 | 2/2011 | Yoshikawa et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0076071 | A1 | 3/2011 | Yamaguchi et al. |

(Continued)

FOREIGN PATENT DOCUMENTS

| | | |
|---|---|---|
| JP | 4-50883 | 2/1992 |
| JP | 4-106028 | 4/1992 |

(Continued)

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A fixing device includes a fixing belt looped over a heating rotary body and a stationary pad and an anti-slip member contacting an outer circumferential surface of the fixing belt in a lateral end span in an axial direction of the heating rotary body to press the fixing belt against the heating rotary body to prevent slippage of the heating rotary body and the fixing belt. The lateral end span is at each lateral end of the heating rotary body and outboard from a center span in the axial direction of the heating rotary body.

18 Claims, 8 Drawing Sheets

U.S. PATENT DOCUMENTS

| | | | |
|---|---|---|---|
| 2011/0085832 | A1 | 4/2011 | Hasegawa et al. |
| 2011/0116848 | A1 | 5/2011 | Yamaguchi et al. |
| 2011/0176822 | A1 | 7/2011 | Ishii et al. |
| 2011/0182609 | A1 | 7/2011 | Hasegawa et al. |
| 2011/0182634 | A1 | 7/2011 | Ishigaya et al. |
| 2011/0182638 | A1 | 7/2011 | Ishii et al. |
| 2011/0194869 | A1 | 8/2011 | Yoshinaga et al. |
| 2011/0200370 | A1 | 8/2011 | Ikebuchi et al. |
| 2011/0206425 | A1 | 8/2011 | Seto et al. |
| 2011/0211876 | A1 | 9/2011 | Iwaya et al. |
| 2011/0217056 | A1 | 9/2011 | Yoshinaga et al. |
| 2011/0217057 | A1 | 9/2011 | Yoshinaga et al. |
| 2011/0217091 | A1 | 9/2011 | Hirose et al. |
| 2011/0217094 | A1 | 9/2011 | Hasegawa |
| 2011/0217095 | A1 | 9/2011 | Ishii et al. |
| 2011/0222875 | A1 | 9/2011 | Imada et al. |
| 2011/0222929 | A1 | 9/2011 | Fujimoto et al. |
| 2011/0222931 | A1 | 9/2011 | Shinshi et al. |
| 2011/0222934 | A1 | 9/2011 | Hasegawa |
| 2011/0229200 | A1 | 9/2011 | Yamaguchi et al. |
| 2011/0274453 | A1 | 11/2011 | Shimokawa et al. |
| 2011/0305491 | A1 | 12/2011 | Hasegawa et al. |
| 2012/0014725 | A1 | 1/2012 | Seto et al. |
| 2012/0044516 | A1 | 2/2012 | Hirose et al. |

FOREIGN PATENT DOCUMENTS

| | | |
|---|---|---|
| JP | 2004-198556 | 7/2004 |
| JP | 2004-252354 | 9/2004 |
| JP | 2007-334205 | 12/2007 |
| JP | 2011-191380 | 9/2011 |

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Applications Nos. 2011-082385, filed on Apr. 4, 2011, and 2011-111550, filed on May 18, 2011, in the Japanese Patent Office, the entire disclosure of each of which is hereby incorporated herein by reference.

FIELD OF THE INVENTION

Exemplary aspects of the present invention relate to a fixing device and an image forming apparatus, and more particularly, to a fixing device for fixing a toner image on a recording medium and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

FIG. 1 illustrates a fixing device 9R installed in such image forming apparatuses, which includes a fixing roller 91R and a pressing roller 92R that apply heat and pressure to a recording medium P bearing a toner image. For example, the pressing roller 92R heated by a halogen heater 98R disposed inside the pressing roller 92R is pressed against the fixing roller 91R heated by a halogen heater 97R disposed inside the fixing roller 91R to form a fixing nip N therebetween through which the recording medium P bearing the toner image is conveyed. As the fixing roller 91R and the pressing roller 92R rotate and convey the recording medium P in a recording medium conveyance direction C1 through the fixing nip N, the fixing roller 91R and the pressing roller 92R apply heat and pressure to the recording medium P, melting and fixing the toner image on the recording medium P. The fixing roller 91R is constructed of a metal pipe 93R and a rubber layer 95R coating the metal pipe 93R. Similarly, the pressing roller 92R is constructed of a metal pipe 94R and a rubber layer 96R coating the metal pipe 94R. Since the rubber layers 95R and 96R work as a thermal resistor, the rubber layers 95R and 96R have a small thickness that creates a short fixing nip length in the recording medium conveyance direction C1. Accordingly, the fixing roller 91R and the pressing roller 92R that form the short fixing nip length may apply heat and pressure to the recording medium P insufficiently when the recording medium P is conveyed at high speed, resulting in faulty fixing.

To address this problem, a fixing device 10R incorporating a fixing belt 7R that creates a longer fixing nip length is proposed as shown in FIG. 2. For example, the fixing belt 7R is stretched over a fixing roller 4R and a heating roller 8R. A pressing roller 2R is pressed against the fixing roller 4R via the fixing belt 7R to form a fixing nip N between the pressing roller 2R and the fixing belt 7R. As a recording medium P is conveyed through the fixing nip N in a recording medium conveyance direction C2, the fixing belt 7R heated by a heater 5R via the heating roller 8R and the pressing roller 2R heated by a heater 6R apply heat and pressure to the recording medium P, melting and fixing the toner image on the recording medium P. Since the fixing roller 4R incorporates a thick rubber layer, the fixing roller 4R creates the longer fixing nip length in the recording medium conveyance direction C2. However, in order to attain the longer fixing nip length, the fixing roller 4R needs to have a greater loop diameter that decreases the curvature of the fixing roller 4R and the fixing belt 7R stretched over the fixing roller 4R, hindering separation of the recording medium P from the fixing belt 7R after it is discharged from the fixing nip N. Accordingly, a separator 3R that contacts the fixing belt 7R to separate the recording medium P from the fixing belt 7R is required at the exit of the fixing nip N, upsizing the fixing device 10R.

To address the drawbacks of the fixing device 10R shown in FIG. 2, a fixing device incorporating a stationary pad instead of the fixing roller 4R is proposed. For example, the stationary pad has a substantially rectangular shape in cross-section that increases the fixing nip length and at the same time provides a greater curvature that facilitates separation of the recording medium from a fixing belt stretched over the stationary pad without the separator 3R shown in FIG. 2. However, the stationary pad is too small to endure high pressure from a pressing roller pressed against the stationary pad via the fixing belt, failing to form the uniform fixing nip.

Recently, the image forming apparatuses are requested to form a high quality color toner image on a recording medium at high speed. In order to fix the high quality color toner image on the recording medium, a higher pressure and a longer nip time for which the recording medium bearing the toner image is conveyed through the fixing nip to receive heat and pressure are required. Accordingly, a longer fixing nip length is required to allow the recording medium to be conveyed through the fixing nip for the longer nip time even at high speed. However, as described above, the component (e.g., the fixing roller 4R depicted in FIG. 2) that creates the longer fixing nip length and at the same time endures the higher pressure from the pressing roller 2R may have the great size that decreases its curvature, thus hindering separation of the recording medium P from the fixing belt 7R after the recording medium P is discharged from the fixing nip N. Conversely, the component (e.g., the stationary pad) that creates the longer fixing nip length and at the same time provides the greater curvature may not endure the higher pressure from the pressing roller. Additionally, the fixing belt 7R looped over the fixing roller 4R or the stationary pad that creates the longer fixing nip length may slip over the fixing roller 4R or the stationary pad, resulting in faulty conveyance of the recording medium P passing through the fixing nip N and ineffective heat conduction from the heating roller 8R to the fixing belt 7R.

Accordingly, there is a need for a technology that attains the higher pressure and the longer fixing nip length at the fixing nip N required to form a high quality color toner image as well as the greater curvature required to separate the recording medium P from the fixing belt 7R without slippage of the fixing belt 7R.

SUMMARY OF THE INVENTION

This specification describes below an improved fixing device. In one exemplary embodiment of the present invention, the fixing device includes a heating rotary body rotatable in a predetermined direction of rotation; a heater disposed opposite the heating rotary body to heat the heating rotary body; a stationary pad contacting an outer circumferential surface of the heating rotary body that slides over the stationary pad in a center span in an axial direction of the heating rotary body; and a flexible endless fixing belt looped over the heating rotary body and the stationary pad. A pressing rotary body rotatable in a direction counter to the direction of rotation of the heating rotary body is pressed against the heating rotary body via the fixing belt and the stationary pad interposed between the fixing belt and heating rotary body to form a fixing nip between the pressing rotary body and the fixing belt through which a recording medium bearing a toner image is conveyed. The pressing rotary body drives and rotates the fixing belt by friction therebetween which in turn drives and rotates the heating rotary body by friction between the fixing belt and the heating rotary body. An anti-slip member contacts an outer circumferential surface of the fixing belt in a lateral end span in the axial direction of the heating rotary body to press the fixing belt against the heating rotary body to prevent slippage of the heating rotary body and the fixing belt. The lateral end span is at each lateral end of the heating rotary body and outboard from the center span in the axial direction of the heating rotary body.

This specification further describes an improved fixing device. In one exemplary embodiment, the fixing device includes a heating rotary body rotatable in a predetermined direction of rotation; a heater disposed opposite the heating rotary body to heat the heating rotary body; a stationary pad contacting an outer circumferential surface of the heating rotary body that slides over the stationary pad in a center span in an axial direction of the heating rotary body; and a flexible endless fixing belt looped over the heating rotary body and the stationary pad. A pressing rotary body rotatable in a direction counter to the direction of rotation of the heating rotary body is pressed against the heating rotary body via the fixing belt and the stationary pad interposed between the fixing belt and heating rotary body to form a fixing nip between the pressing rotary body and the fixing belt through which a recording medium bearing a toner image is conveyed. The pressing rotary body drives and rotates the fixing belt by friction therebetween which in turn drives and rotates the heating rotary body by friction between the fixing belt and the heating rotary body. A frictional roughened surface portion is mounted on at least one of an inner circumferential surface of the fixing belt and the outer circumferential surface of the heating rotary body in a lateral end span in the axial direction of the heating rotary body to prevent slippage of the heating rotary body and the fixing belt. The lateral end span is at each lateral end of the heating rotary body and outboard from the center span in the axial direction of the heating rotary body.

This specification further describes an improved fixing device. In one exemplary embodiment, the fixing device includes a heating rotary body rotatable in a predetermined direction of rotation; a heater disposed opposite the heating rotary body to heat the heating rotary body; a stationary pad contacting an outer circumferential surface of the heating rotary body that slides over the stationary pad in a center span in an axial direction of the heating rotary body; and a flexible endless fixing belt looped over the heating rotary body and the stationary pad. A pressing rotary body rotatable in a direction counter to the direction of rotation of the heating rotary body is pressed against the heating rotary body via the fixing belt and the stationary pad interposed between the fixing belt and heating rotary body to form a fixing nip between the pressing rotary body and the fixing belt through which a recording medium bearing a toner image is conveyed. The pressing rotary body drives and rotates the fixing belt by friction therebetween which in turn drives and rotates the heating rotary body by friction between the fixing belt and the heating rotary body. A first engagement member is mounted on the heating rotary body. A second engagement member is mounted on the fixing belt to engage the first engagement member of the heating rotary body to prevent slippage of the heating rotary body and the fixing belt. The first engagement member and the second engagement member are in a lateral end span provided at each lateral end of the heating rotary body and outboard from the center span in the axial direction of the heating rotary body.

This specification further describes an improved image forming apparatus. In one exemplary embodiment, the image forming apparatus includes any one of the fixing devices described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
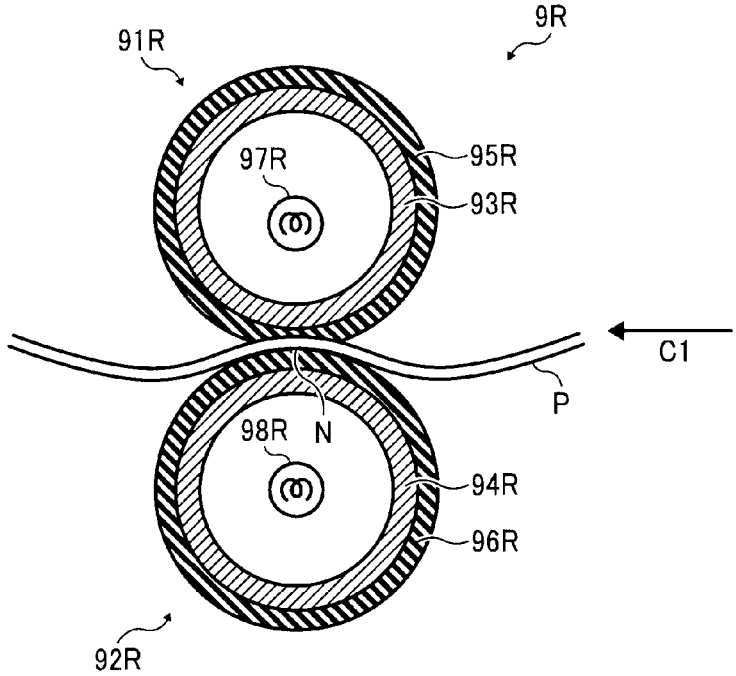
FIG. 1 RELATED ART
FIG. 1 is a schematic vertical sectional view of one related-art fixing device.
Figure 2:
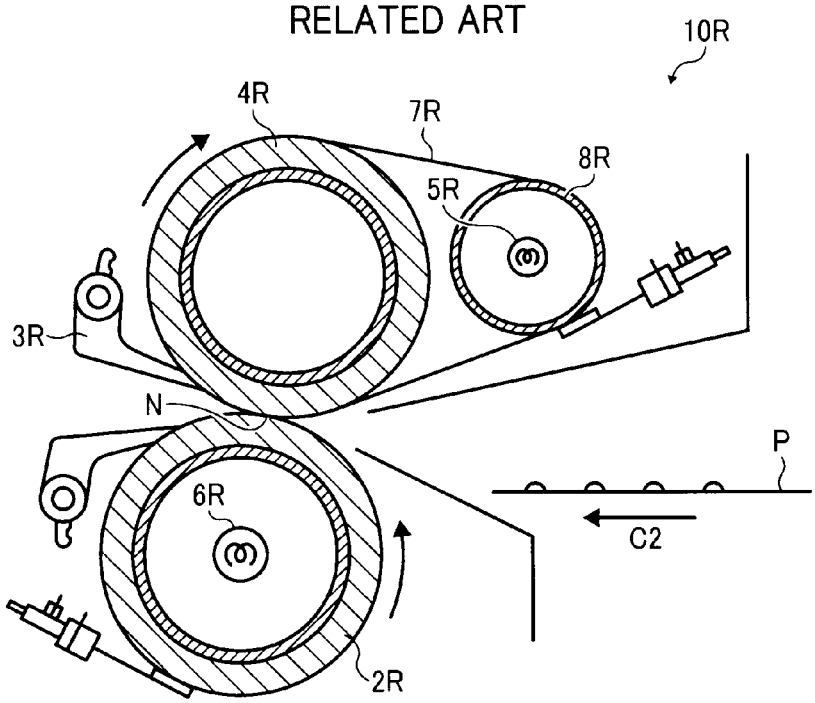
FIG. 2 RELATED ART
FIG. 2 is a schematic vertical sectional view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 3:
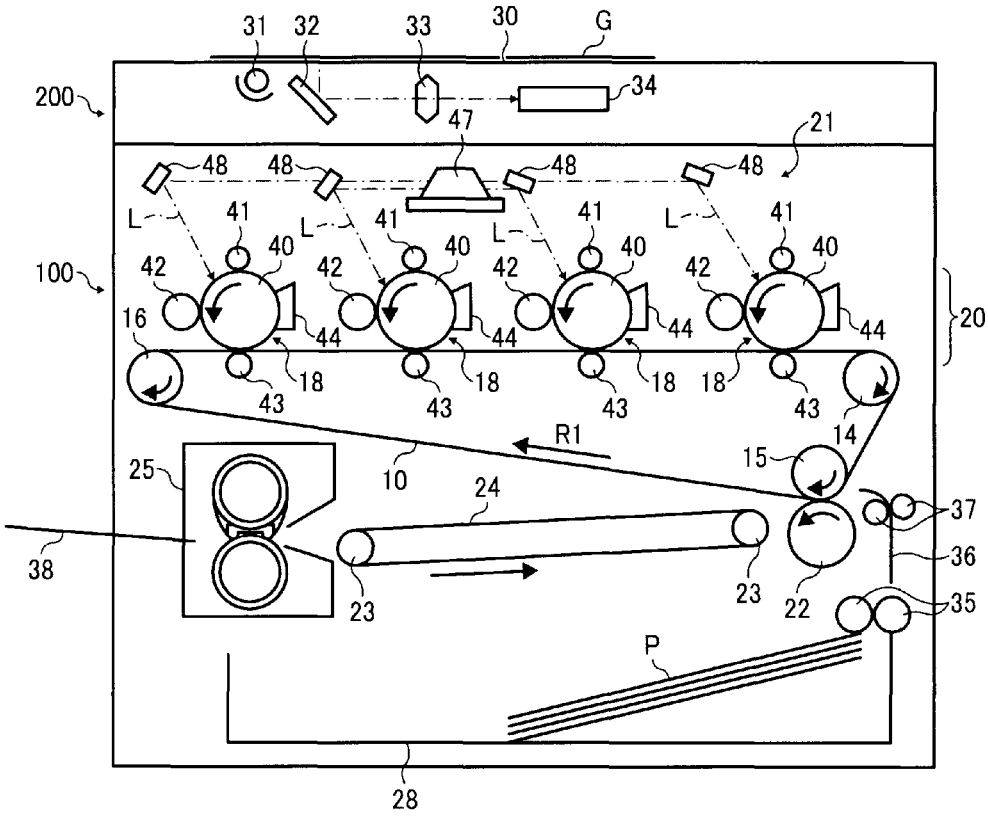
FIG. 3 is a schematic sectional view of an image forming apparatus according to an exemplary embodiment of the present invention.

Referring now to the drawings, wherein like reference numerals designate identical or corresponding parts throughout the several views, in particular to FIG. 3, an image forming apparatus 100 according to an exemplary embodiment of the present invention is explained.

FIG. 3 is a schematic sectional view of the image forming apparatus 100. The image forming apparatus 100 may be a copier, a facsimile machine, a printer, a multifunction printer having at least one of copying, printing, scanning, plotter, and facsimile functions, or the like. According to this exemplary embodiment, the image forming apparatus 100 is a color copier for forming color and monochrome toner images on a recording medium by electrophotography.

Referring to FIG. 3, the following describes the structure of the image forming apparatus 100.

The image forming apparatus 100 includes an endless belt-shaped intermediate transferor 10 disposed in a center portion of the image forming apparatus 100. The intermediate transferor 10 is looped over three rollers, that is, a driving roller 14, a first driven roller 15, and a second driven roller 16, and is rotatable clockwise in FIG. 3 in a rotation direction R1. Alternatively, the intermediate transferor 10 may be looped over four or more rollers including a roller configured to prevent skew of the intermediate transferor 10. According to this exemplary embodiment, the intermediate transferor 10 is stretched in a substantially horizontal direction. Alternatively, the intermediate transferor 10 may be stretched diagonally.

A belt cleaner is disposed opposite and in proximity to the second driven roller 16 via the intermediate transferor 10 to remove residual toner remaining on the intermediate transferor 10 therefrom after a secondary transfer process described below.

A tandem image forming unit 20 is disposed above the intermediate transferor 10 stretched over the driving roller 14 and the second driven roller 16. The tandem image forming unit 20 includes four image forming devices 18 aligned in the rotation direction R1 of the intermediate transferor 10 to form black, yellow, magenta, and cyan toner images thereon, respectively. Above the tandem image forming unit 20 is an exposure device 21 above which a scanner 200 is disposed.

Below the intermediate transferor 10 is a secondary transfer device 22 including a roller pressed against the first driven roller 15 via the intermediate transferor 10 to form a secondary transfer nip between the secondary transfer device 22 and the intermediate transferor 10. As a recording medium P is conveyed through the secondary transfer nip, the secondary transfer device 22 presses the recording medium P against the intermediate transferor 10 so that a toner image formed on the intermediate transferor 10 is transferred onto the recording medium P. Downstream from the secondary transfer device 22 in the rotation direction R1 of the intermediate transferor 10 is an endless conveyance belt 24 looped over two rollers 23. Downstream from the conveyance belt 24 in the rotation direction R1 of the intermediate transferor 10 is a fixing device 25 that fixes the toner image on the recording medium P. Downstream from the fixing device 25 in the rotation direction R1 of the intermediate transferor 10 is an output tray 38 that receives the recording medium P conveyed from the fixing device 25.

The secondary transfer device 22 transfers the toner image from the intermediate transferor 10 onto the recording medium P while conveying the recording medium P toward the conveyance belt 24. Alternatively, the secondary transfer device 22 may include a non-contact charger instead of the roller. In this case, the non-contact charger transfers the toner image from the intermediate transferor 10 onto the recording medium P but does not convey the recording medium P toward the conveyance belt 24.

Below the secondary transfer device 22, the conveyance belt 24, and the fixing device 25 is a paper tray 28 that loads a plurality of recording media P such as sheets and OHP (overhead projector) transparencies.

Referring to FIG. 3, the following describes a copying operation of the image forming apparatus 100 having the structure described above.

A user sets an original document G on an exposure glass 30 of the scanner 200 and lowers an original document cover that presses the original document G against the exposure glass 30. As the user presses a start button on a control panel disposed atop the image forming apparatus 100, the scanner 200 is driven to read an image on the original document G. For example, a light source 31 (e.g., a halogen lamp) emits light onto the original document G and a mirror 32 reflects the light reflected by the original document G to a lens 33. The lens 33 collects the light into a charge-coupled device (CCD) 34 that forms the image and converts the image into an electric signal.

Simultaneously, as the user presses the start button on the control panel, a driver drives and rotates the driving roller 14 clockwise in FIG. 3 that in turn rotates the intermediate transferor 10 in the rotation direction R1. The rotating intermediate transferor 10 rotates the first driven roller 15 and the second driven roller 16 clockwise in FIG. 3. Simultaneously, drum-shaped photoconductors 40 incorporated in the image forming devices 18 rotate counterclockwise in FIG. 3 to form black, yellow, magenta, and cyan toner images thereon, respectively. As the intermediate transferor 10 rotates in the rotation direction R1, primary transfer devices 43 disposed opposite the photoconductors 40 primarily transfer the black, yellow, magenta, and cyan toner images from the photoconductors 40 onto the intermediate transferor 10 successively in such a manner that the black, yellow, magenta, and cyan toner images are superimposed on the same position on the intermediate transferor 10, thus forming a color toner image on the intermediate transferor 10.

On the other hand, as the user presses the start button on the control panel, a feed roller pair 35 is rotated to feed a recording medium P from the paper tray 28. The recording medium P is conveyed through a conveyance path 36 to a registration roller pair 37 that halts temporarily to strike and halt a leading edge of the recording medium P.

At a time to transfer the color toner image formed on the intermediate transferor 10 onto the recording medium P, the registration roller pair 37 resumes rotating to feed the recording medium P to the secondary transfer nip formed between the secondary transfer device 22 and the intermediate transferor 10. As the recording medium P is conveyed through the secondary transfer nip, the secondary transfer device 22 secondarily transfers the color toner image from the intermediate transferor 10 onto the recording medium P, thus forming the color toner image on the recording medium P.

The recording medium P bearing the color toner image is conveyed on the conveyance belt 24 to the fixing device 25. Then, the fixing device 25 applies heat and pressure to the recording medium P to fix the color toner image on the recording medium P. Thereafter, the recording medium P bearing the fixed color toner image is discharged onto the output tray 38.

The belt cleaner disposed opposite the intermediate transferor 10 removes residual toner not transferred onto the recording medium P and therefore remaining on the intermediate transferor 10 therefrom. Thus, the tandem image forming unit 20 is ready for a next image forming operation.

A detailed description is now given of the tandem image forming unit 20 described above.

The tandem image forming unit 20 includes the image forming devices 18 that incorporate chargers 41, development devices 42, the primary transfer devices 43, cleaners 44, and dischargers that surround the drum-shaped photoconductors 40, respectively. A part or all of the components incorporated in the respective image forming devices 18 may constitute a process cartridge detachably attached to the image forming apparatus 100 to facilitate maintenance.

For example, each of the chargers 41 includes a charging roller that contacts the photoconductor 40 to apply a voltage so as to charge the photoconductor 40. Each of the development devices 42 uses a two-component developer containing magnetic carrier particles and non-magnetic toner particles. Each of the primary transfer devices 43 includes a roller that presses the intermediate transferor 10 against the photoconductor 40. Alternatively, each of the primary transfer devices 43 may include a brush or a non-contact charger. Each of the cleaners 44 includes a cleaning blade or a cleaning brush that contacts the photoconductor 40 to remove residual toner remaining on the photoconductor 40 therefrom. Each of the dischargers includes a lamp that emits light onto the photoconductor 40 to initialize a surface potential thereof.

With the configuration of the image forming devices 18 described above, as the photoconductors 40 rotate counterclockwise in FIG. 3, the chargers 41 uniformly charge an outer circumferential surface of the respective photoconductors 40. The exposure device 21 emits light L onto the charged outer circumferential surface of the respective photoconductors 40 according to the image signal sent from the scanner 200. Specifically, a polygon mirror 47 reflects light L (e.g., a laser beam) emitted by a light source (e.g., a light emitting diode (LED)) toward mirrors 48. The mirrors 48 reflect the light L to the photoconductors 40, forming electrostatic latent images thereon.

Then, the development devices 42 supply black, yellow, magenta, and cyan toners to the electrostatic latent images, rendering the electrostatic latent images visible as black, yellow, magenta, and cyan toner images, respectively. The primary transfer devices 43 transfer the black, yellow, magenta, and cyan toner images from the photoconductors 40 onto the intermediate transferor 10, respectively. After the transfer of the black, yellow, magenta, and cyan toner images, the cleaners 44 remove residual toners not transferred and therefore remaining on the outer circumferential surface of the respective photoconductors 40 therefrom. Thereafter, the dischargers discharge the photoconductors 40. Thus, the image forming devices 18 become ready for the next image forming operation.

Figure 4:
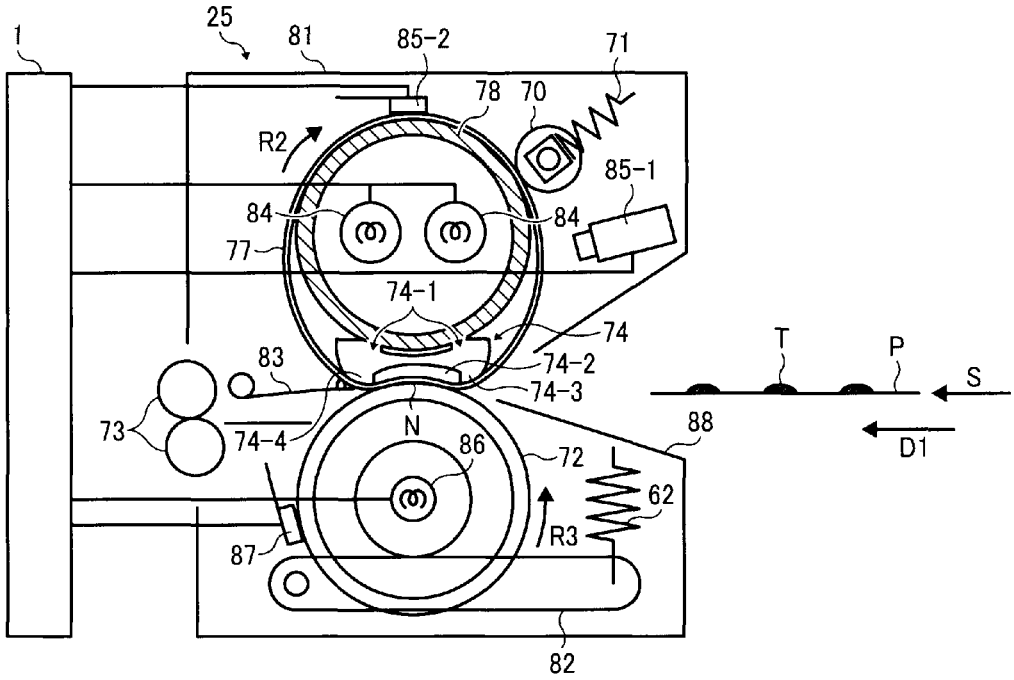
FIG. 4 is a vertical sectional front view of a fixing device installed in the image forming apparatus shown in FIG. 3.
Figure 5:
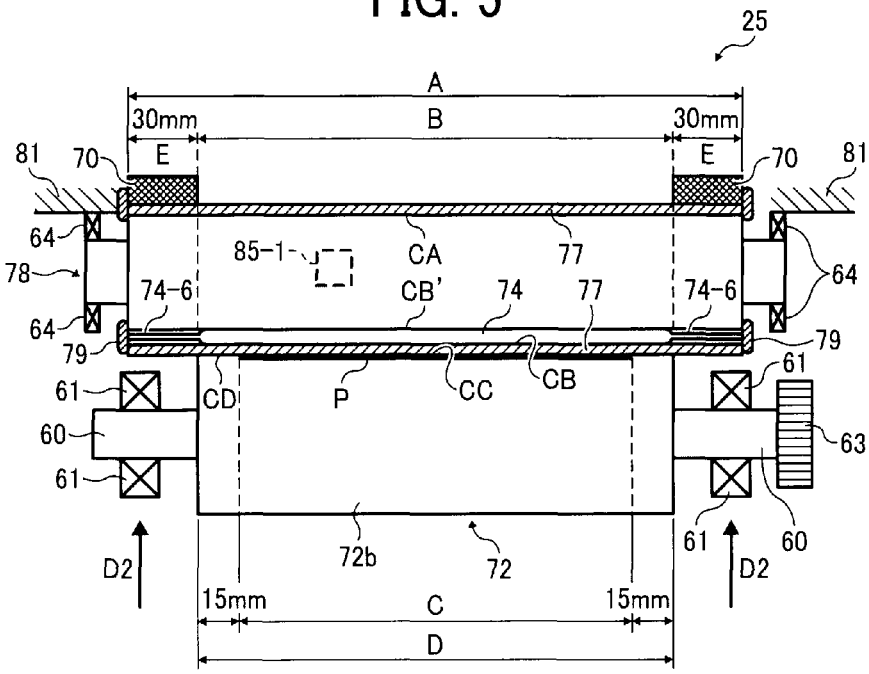
FIG. 5 is a horizontal side view of the fixing device shown in FIG. 4 illustrating a first example of an anti-slip member.

Referring to FIGS. 4 and 5, the following describes the structure and operation of the fixing device 25 incorporated in the image forming apparatus 100 described above.

FIG. 4 is a vertical sectional front view of the fixing device 25. FIG. 5 is a horizontal side view of the fixing device 25 seen in a direction S in FIG. 4.

As shown in FIG. 4, the fixing device 25 includes a heating roller 78 serving as a heating rotary body that rotates clockwise in FIG. 4 in a rotation direction R2; two heaters 84 serving as a heater or a heat source that heats the heating roller 78; a stationary pad 74 that contacts a part of an outer circumferential surface of the heating roller 78 in such a manner that the heating roller 78 slides over the stationary pad 74; a flexible endless fixing belt 77 looped over the heating roller 78 and the stationary pad 74; and a pressing roller 72 serving as a pressing rotary body pressed against the stationary pad 74 via the fixing belt 77 to form a fixing nip N between the pressing roller 72 and the fixing belt 77. As a driver drives and rotates the pressing roller 72 counterclockwise in FIG. 4 in a rotation direction R3, the pressing roller 72 drives and rotates the fixing belt 77 by friction therebetween. For example, the pressing roller 72, the fixing belt 77, the stationary pad 74, and the heating roller 78 are aligned in this order in an upward pressing direction D2 in FIG. 5 in which the pressing roller 72 exerts pressure to the heating roller 78 via the fixing belt 77 and the stationary pad 74 at the fixing nip N. As shown in FIG. 5, a contact span A in an axial direction of the heating roller 78 where the heating roller 78 contacts an inner circumferential surface of the fixing belt 77 is greater than a contact span B in the axial direction of the heating roller 78 where the stationary pad 74 contacts the inner circumferential surface of the fixing belt 77. The fixing device 25 further includes anti-slip rollers 70 serving as an anti-slip member that prevents slippage of the fixing belt 77 frictionally contacting the heating roller 78. The anti-slip rollers 70 are disposed at both lateral ends of the fixing belt 77 outboard from the contact span B in the axial direction of the heating roller 78.

In this specification, a "circumferential direction" defines the rotation direction R2 of the heating roller 78 and an "axial direction" defines the axial direction of the heating roller 78 unless otherwise specified.

As shown in FIG. 5, the heating roller 78 is rotatably supported by a frame 81 of the fixing device 25. As shown in FIG. 4, the stationary pad 74 is disposed inside an elliptical loop formed by the fixing belt 77 in such a manner that the stationary pad 74 is movable only bidirectionally, that is, upward and downward in FIG. 4, in a direction substantially perpendicular to a recording medium conveyance direction D1. The stationary pad 74 contacts the inner circumferential surface of the fixing belt 77 and the outer circumferential surface of the heating roller 78. Thus, as the heating roller 78 rotates in the rotation direction R2, the heating roller 78 slides over the stationary pad 74. The flexible endless fixing belt 77 is stretched over the heating roller 78 and the stationary pad 74, forming the elliptical loop. The pressing roller 72 is pressed against the stationary pad 74 via the fixing belt 77 to form the fixing nip N between the pressing roller 72 and the fixing belt 77 contacting each other.

The pressing roller 72 brings the fixing belt 77 into contact with the stationary pad 74 and at the same time the fixing belt 77 generates a tension to recover its circular loop. Thus, the fixing belt 77 comes into contact with the heating roller 78.

A pressure is exerted to the pressing roller 72 upward in FIG. 4 and is transmitted to the fixing belt 77, the stationary pad 74, and the heating roller 78. In other words, the pressure is exerted at least at three interfaces, that is, the fixing nip N where the pressing roller 72 contacts the fixing belt 77, a contact section where the fixing belt 77 contacts the stationary pad 74, and a contact section where the stationary pad 74 contacts the heating roller 78.

A separation plate 83 is disposed downstream from an exit of the fixing nip N in the recording medium conveyance direction D1 in such a manner that an upstream edge of the separation plate 83 facing the fixing nip N is isolated from the fixing belt 77. The separation plate 83 prohibits a recording medium P discharged from the fixing nip N from adhering to the fixing belt 77, thus facilitating separation of the recording medium P from the fixing belt 77. For example, the separation plate 83 has a rotation axis at a downstream end thereof in the recording medium conveyance direction D1. The separation plate 83 includes positioning portions disposed at an upstream end thereof in the recording medium conveyance direction D1 disposed in proximity to the upstream edge of the separation plate 83 and at both lateral ends of the separation plate 83 outboard from a recording medium conveyance region corresponding to a width of the recording medium P in the axial direction of the heating roller 78. Biasing members (e.g., springs) connected to the lateral ends of the separation plate 83 bias the separation plate 83 with respect to the fixing belt 77, creating a slight gap between the upstream edge of the separation plate 83 and the fixing belt 77. With this configuration of the separation plate 83, the separation plate 83 guides the recording medium P discharged from the exit of the fixing nip N and separated from the fixing belt 77 by itself to a conveyance roller pair 73 disposed downstream from the separation plate 83 in the recording medium conveyance direction D1, thus preventing the recording medium P from being wound around the fixing belt 77.

The heaters 84 are disposed inside the heating roller 78. According to this exemplary embodiment, each of the heaters 84 is a halogen heater or an infrared heater. Alternatively, each heater 84 may be an induction heater, a thermal resistor, or the like. Further, according to this exemplary embodiment, the two heaters 84 are disposed inside the heating roller 78. Alternatively, a single heater may be disposed inside or outside the heating roller 78.

A thermopile 85-1 is disposed opposite an outer circumferential surface of the fixing belt 77 at a position in proximity to a separation position where the fixing belt 77 looped over the heating roller 78 separates from the heating roller 78 and upstream from the fixing nip N in the rotation direction R2 of the heating roller 78. The thermopile 85-1 detects the temperature of the outer circumferential surface of the fixing belt 77. The thermopile 85-1 is isolated from the outer circumferential surface of the fixing belt 77 and disposed opposite the recording medium conveyance region on the fixing belt 77 through which the recording medium P is conveyed that is defined by a contact span C of an interface CC in the axial direction of the heating roller 78 where the recording medium P contacts the fixing belt 77 as shown in FIG. 5. For example, the thermopile 85-1 is disposed opposite a rectangular region on the outer circumferential surface of the fixing belt 77 indicated by the dotted line in FIG. 5.

As shown in FIG. 4, a thermistor 85-2 is disposed opposite the outer circumferential surface of the fixing belt 77 at a position where the fixing belt 77 contacts the heating roller 78, detecting the temperature of the outer circumferential surface of the fixing belt 77. The thermistor 85-2 contacts the outer circumferential surface of the fixing belt 77 at a position outboard from the recording medium conveyance region defined by the contact span C depicted in FIG. 5 in the axial direction of the heating roller 78 that is different from the positions of the anti-slip rollers 70, a detailed description of which is deferred.

A controller 1, that is, a central processing unit (CPU) provided with a random-access memory (RAM) and a read-only memory (ROM), for example, is operatively connected to the thermopile 85-1, the thermistor 85-2, and the heaters 84. The controller 1 controls the heaters 84 to maintain the temperature of the heating roller 78 at a predetermined temperature. For example, the controller 1 turns on and off the heaters 84 based on the temperature of the fixing belt 77 detected by the thermistor 85-2 when the fixing belt 77 halts. Conversely, the controller 1 turns on and off the heaters 84 based on the temperature of the fixing belt 77 detected by the thermopile 85-1 when the fixing belt 77 rotates.

Similarly, a heater 86 (e.g., a halogen heater) is disposed inside the pressing roller 72. A thermistor 87 is pressed against an outer circumferential surface of the pressing roller 72. The controller 1 is also operatively connected to the heater 86 and the thermistor 87 to control the heater 86 so as to maintain the temperature of the pressing roller 72 at a predetermined temperature. For example, the controller 1 turns on and off the heater 86 based on the temperature of the pressing roller 72 detected by the thermistor 87. Alternatively, the heater 86 may be unnecessary.

An entry guide 88 is disposed upstream from the fixing nip N in the recording medium conveyance direction D1 and in proximity to an entry to the fixing nip N, thus guiding the recording medium P to the fixing nip N.

The outer circumferential surface of the fixing belt 77 is contacted by the thermistor 85-2 and lateral ends of the separation plate 83 in the axial direction of the heating roller 78. However, both the thermistor 85-2 and the lateral ends of the separation plate 83 are disposed at positions outboard from the recording medium conveyance region on the fixing belt 77 defined by the contact span C depicted in FIG. 5 in the axial direction of the heating roller 78. Accordingly, the recording medium conveyance region defined by the contact span C on the fixing belt 77 is neither damaged nor worn out, preventing the worn-out fixing belt 77 from damaging a toner image T on the recording medium P.

A detailed description is now given of the pressing roller 72.

The pressing roller 72 is constructed of a metal pipe made of steel or the like; a silicone rubber layer coating the metal pipe and having a thickness of about 2 mm; and a surface release layer coating the silicone rubber layer, that is, a fluoroplastic tube having a thickness of about 30 micrometers. As shown in FIG. 5, the pressing roller 72 has a loop diameter of about 50 mm and is attached with journals 60, each of which has a loop diameter of about 25 mm, at both lateral ends of the pressing roller 72 in an axial direction thereof. Bearings 61 are mounted on the journals 60, respectively. As shown in FIG. 4, a pressing lever 82 is rotatably mounted on the frame 81 at each lateral end of the pressing roller 72 in the axial direction thereof A spring 62 is attached to the pressing lever 82. The spring 62 presses the pressing lever 82 against the bearing 61 to move the pressing roller 72 toward the heating roller 78. Thus, the spring 62 and the pressing lever 82 constitute a pressing mechanism that presses the pressing roller 72 against the stationary pad 74 via the fixing belt 77. As a driving force generated by a driver is transmitted to a gear 63 attached to an end of one of the journals 60, the gear 63 rotates counterclockwise in FIG. 4 in the rotation direction R3, thus rotating the pressing roller 72 in the rotation direction R3. The rotating pressing roller 72 rotates the fixing belt 77 in the rotation direction R2 by friction therebetween at the fixing nip N.

A detailed description is now given of the heating roller 78.

The heating roller 78 is a hollow aluminum pipe with a high thermal conductivity having a thickness in a range of from about 0.5 mm to about 3.0 mm and a loop diameter of about 50 mm. The heating roller 78 is rotated by the fixing belt 77 wound around the heating roller 78 by friction therebetween. The outer circumferential surface of the heating roller 78 is treated with processing described below. An inner circumferential surface of the heating roller 78 is treated with heat-resistant black coating to facilitate absorption of heat from the heaters 84.

As shown in FIG. 5, both lateral ends of the heating roller 78 in the axial direction thereof are rotatably supported by the frame 81 via bearings 64, respectively. The heating roller 78 is driven and rotated by the rotating fixing belt 77 by friction therebetween and heats the fixing belt 77. The heating roller 78 has a rigidity great enough to prevent bending thereof even if the heating roller 78 receives pressure from the pressing roller 72.

A detailed description is now given of the stationary pad 74.

The stationary pad 74 includes an upper face contacting the heating roller 78 over which the heating roller 78 slides and a lower face contacting the fixing belt 77 over which the fixing belt 77 slides. A length of the stationary pad 74 in the recording medium conveyance direction D1 is smaller than an outer diameter of the heating roller 78 and greater than a length of the fixing nip N in the recording medium conveyance direction D1. A height of the stationary pad 74 in a direction substantially perpendicular to the recording medium conveyance direction D1, that is, a vertical direction in FIG. 4, has a dimension that allows the fixing belt 77 to be stretched over the heating roller 78 and the stationary pad 74 loosely.

The stationary pad 74 is made of heat-resistant resin having a desired heat resistance that resists and minimizes heat conducted from the heating roller 78 and a desired sliding property that allows the heating roller 78 to slide over the stationary pad 74 smoothly. For example, the stationary pad 74 is made of polyphenylene sulfide (PPS), polyamideimide (PAI), polyimide (PI), or the like.

An opposed face of the stationary pad 74 disposed opposite the inner circumferential surface of the fixing belt 77 includes a heat-resistant elastic portion 74-2 made of silicone rubber. The heat-resistant elastic portion 74-2 brings the fixing belt 77 into close contact with the recording medium P, facilitating formation of the high quality toner image T on the recording medium P. However, a sliding face of the elastic portion 74-2 as well as other portion of the opposed face of the stationary pad 74 disposed opposite the fixing belt 77 over which the fixing belt 77 slides is coated with fluoroplastic or attached with a fluoroplastic sheet interposed between the opposed face of the stationary pad 74 and the fixing belt 77, thus decreasing a sliding resistance between the stationary pad 74 and the fixing belt 77 sliding over the stationary pad 74.

The stationary pad 74 further includes two contact portions 74-1 disposed opposite the heating roller 78. The two contact portions 74-1 are disposed at two separate positions on the stationary pad 74 disposed opposite the heating roller 78 in a circumferential direction of the stationary pad 74, that is, the rotation direction R2 of the heating roller 78. The heating roller 78 contacts and slides over the two contact portions 74-1 of the stationary pad 74. The contact portions 74-1 have a configuration that minimizes the sliding resistance between the stationary pad 74 and the heating roller 78 sliding over the stationary pad 74 and heat conduction from the heating roller 78 as shown in FIG. 6.

Figure 6:
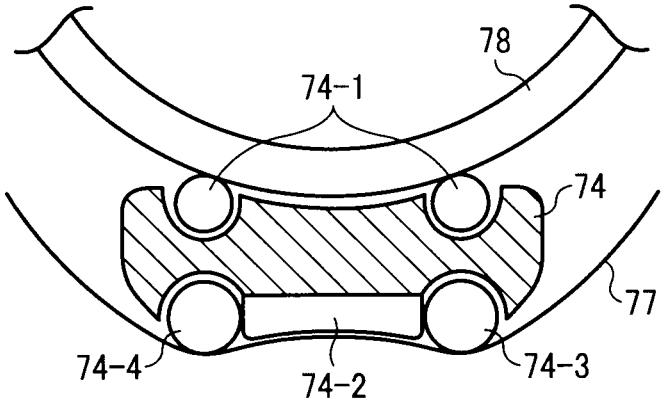
FIG. 6 is a vertical sectional view of a stationary pad incorporated in the fixing device shown in FIG. 4.
Figure 7:
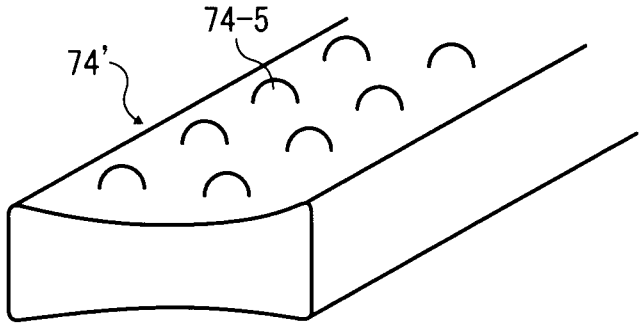
FIG. 7 is a perspective view of a variation of the stationary pad shown in FIG. 6.

FIG. 6 is a vertical sectional view of the stationary pad 74. As shown in FIG. 6, each of the contact portions 74-1 of the stationary pad 74 is a rotary body such as a roller serving as a contact roller that slidably contacts the outer circumferential surface of the heating roller 78. Alternatively, the stationary pad 74 may include a plurality of protrusions 74-5 instead of the contact portions 74-1 as shown in FIG. 7. FIG. 7 is a perspective view of a stationary pad 74' that includes the plurality of protrusions 74-5 instead of the roller-shaped contact portions 74-1 shown in FIG. 6. As shown in FIG. 7, lots of dome-shaped protrusions 74-5 are mounted on an opposed face of the stationary pad 74' that contacts the outer circumferential surface of the heating roller 78 to decrease a contact area where the stationary pad 74' contacts the heating roller 78, thus minimizing the sliding resistance between the stationary pad 74' and the heating roller 78 sliding over the stationary pad 74' and heat conduction from the heating roller 78.

Referring back to FIG. 4, the opposed face of the stationary pad 74 disposed opposite the fixing belt 77 draws a concave curve in cross-section corresponding to a convex curve of the outer circumferential surface of the pressing roller 72, thus forming the curved fixing nip N between the pressing roller 72 and the stationary pad 74. The convex curve of the pressing roller 72 that forms the curved fixing nip N causes the recording medium P conveyed through the fixing nip N to be discharged from the fixing nip N along the outer circumferential surface of the pressing roller 72, facilitating separation of the recording medium P from the fixing belt 77 and thus preventing the recording medium P from being wound around the fixing belt 77. Alternatively, the fixing nip N may be straight in the recording medium conveyance direction D1. For example, the opposed face of the stationary pad 74 disposed opposite the fixing belt 77 may draw a flat straight line in cross-section, thus forming the flat fixing nip N. The flat fixing nip N facilitates conveyance of the recording medium P and therefore minimizes faulty conveyance of the recording medium P such as creasing of the recording medium P.

As shown in FIG. 6, the stationary pad 74 further includes an entry portion 74-3 and an exit portion 74-4 disposed at two separate positions on the opposed face of the stationary pad 74 disposed opposite the fixing belt 77, respectively. The exit portion 74-4 is spaced apart from the entry portion 74-3 with the heat-resistant elastic portion 74-2 interposed therebetween in the recording medium conveyance direction D1. Each of the entry portion 74-3 and the exit portion 74-4 has a small round shape corresponding to the curved outer circumferential surface of the heating roller 78. The inner circumferential surface of the fixing belt 77 contacts the two round portions of the stationary pad 74, that is, the entry portion 74-3 and the exit portion 74-4. If the fixing nip N is formed by the two rollers having the outer diameter of about 50 mm, that is, the heating roller 78 and the pressing roller 72, the fixing nip N has a relatively smaller curvature of 1/25 with a radius of 25 mm at the exit of the fixing nip N, rendering it difficult for the recording medium P to separate from the fixing belt 77 and the pressing roller 72 by itself. To address this problem, according to this exemplary embodiment, the fixing nip N has a relatively greater curvature of 1/8 with a radius of 8 mm at the exit of the fixing nip N, facilitating separation of the recording medium P from the fixing belt 77 and the pressing roller 72 by itself.

The entry portion 74-3 and the exit portion 74-4 of the stationary pad 74 over which the fixing belt 77 slides have a decreased sliding resistance therebetween. For example, as shown in FIG. 6, each of the entry portion 74-3 and the exit portion 74-4 is a rotary body such as a roller that decreases the sliding resistance between the entry portion 74-3 and the exit portion 74-4 and the fixing belt 77 sliding over the entry portion 74-3 and the exit portion 74-4. Thus, the entry portion 74-3 serves as an entry roller disposed at the entry to the fixing nip N to slidably contact the inner circumferential surface of the fixing belt 77. Similarly, the exit portion 74-4 serves as an exit roller disposed at the exit of the fixing nip N to slidably contact the inner circumferential surface of the fixing belt 77. Alternatively, the stationary pad 74 may have other shapes as shown in FIGS. 8A to 8D illustrating four variations of the shape of the stationary pad 74.

Figure 8A:
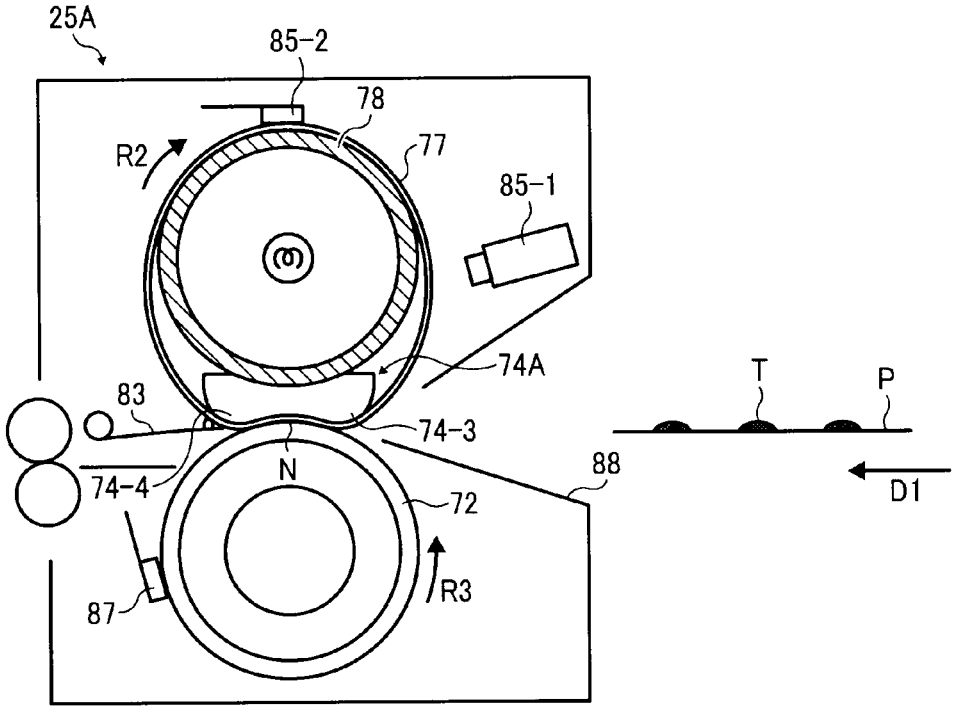
FIG. 8A is a vertical sectional view of a fixing device according to another exemplary embodiment of the present invention, which incorporates a stationary pad as a first variation.
Figure 8B:
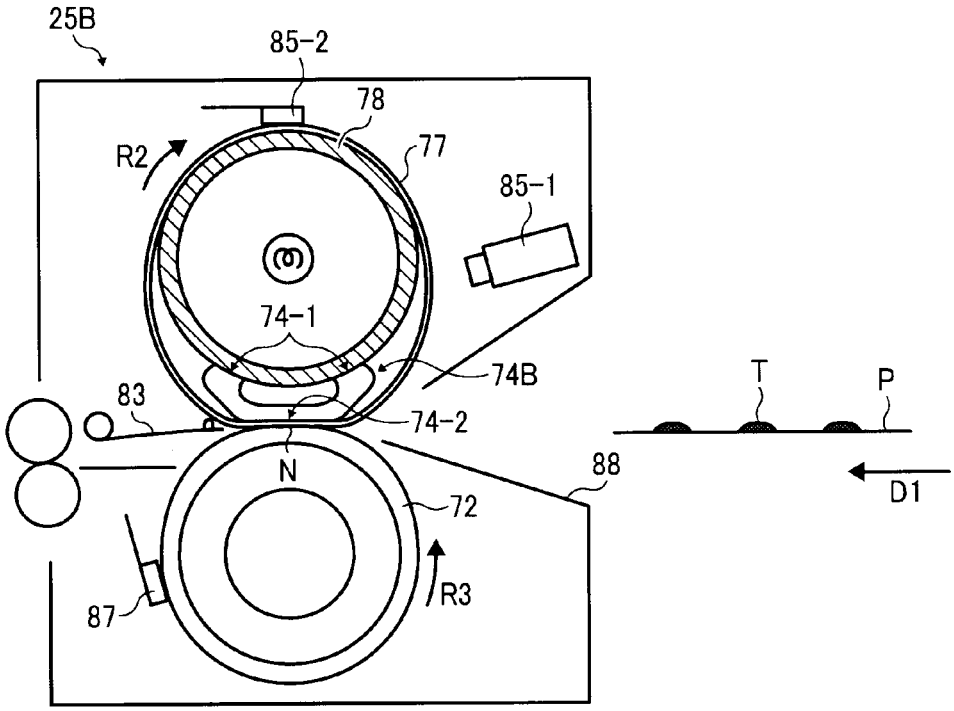
FIG. 8B is a vertical sectional view of a fixing device according to yet another exemplary embodiment of the present invention, which incorporates a stationary pad as a second variation.
Figure 8C:
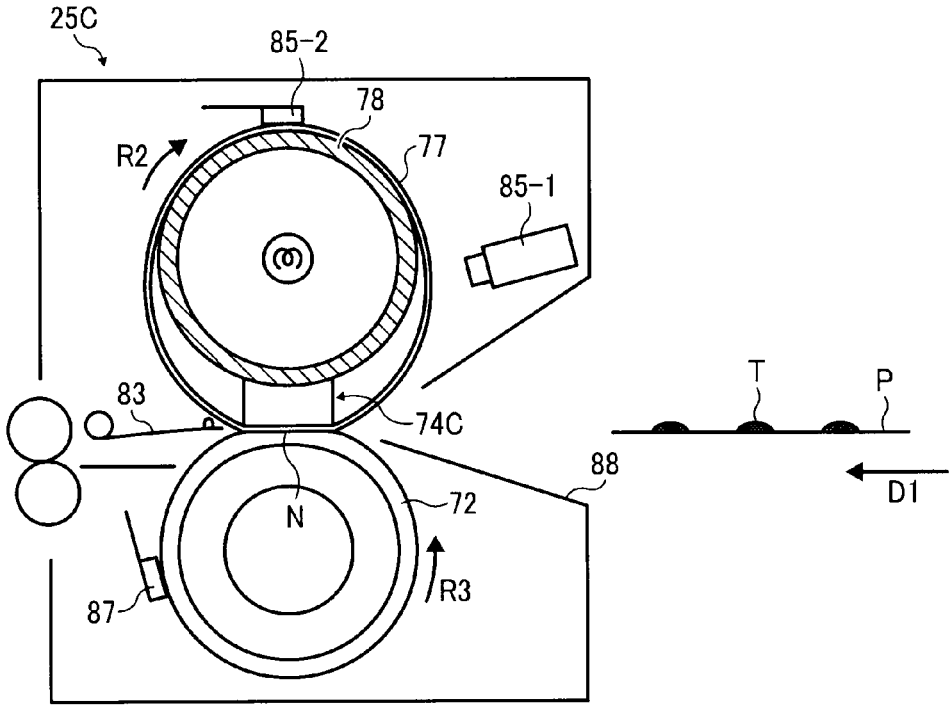
FIG. 8C is a vertical sectional view of a fixing device according to yet another exemplary embodiment of the present invention, which incorporates a stationary pad as a third variation.
Figure 8D:
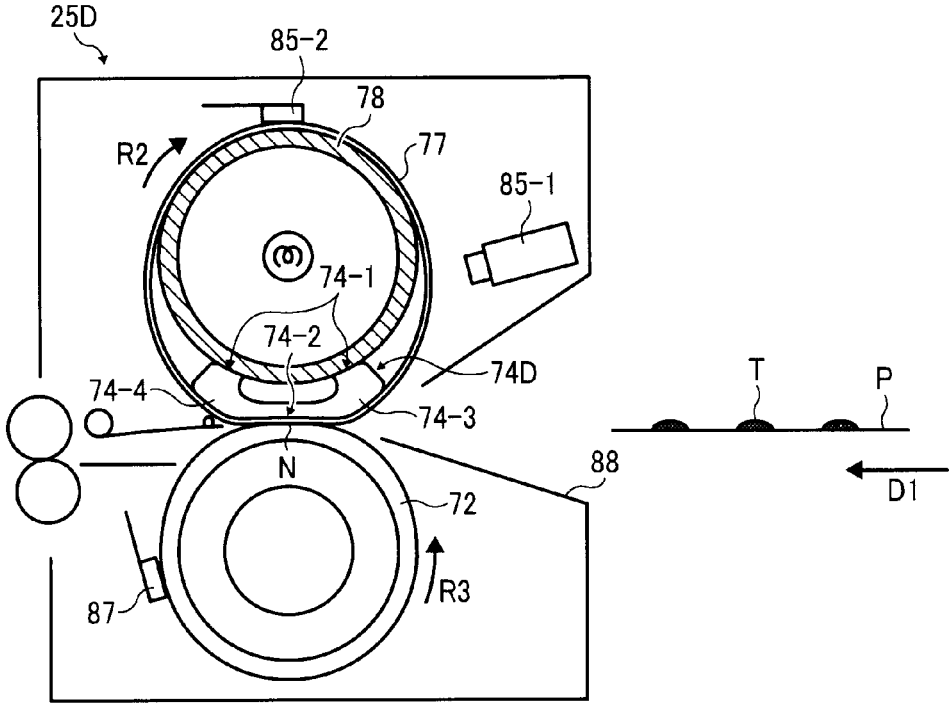
FIG. 8D is a vertical sectional view of a fixing device according to yet another exemplary embodiment of the present invention, which incorporates a stationary pad as a fourth variation.

FIG. 8A is a vertical sectional view of a fixing device 25A incorporating a stationary pad 74A as a first variation. FIG. 8B is a vertical sectional view of a fixing device 25B incorporating a stationary pad 74B as a second variation. FIG. 8C is a vertical sectional view of a fixing device 25C incorporating a stationary pad 74C as a third variation. FIG. 8D is a vertical sectional view of a fixing device 25D incorporating a stationary pad 74D as a fourth variation.

As shown in FIG. 8A, unlike the stationary pad 74 depicted in FIG. 4, the stationary pad 74A may not incorporate the heat-resistant elastic portion 74-2.

As shown in FIG. 8B, unlike the stationary pad 74 depicted in FIG. 4, the stationary pad 74B does not incorporate the entry portion 74-3 and the exit portion 74-4. However, the stationary pad 74B incorporates the curved contact portions 74-1 that have a curvature corresponding to a curvature of the heating roller 78 and contact the heating roller 78 at upstream and downstream regions outboard from the fixing nip N in the recording medium conveyance direction D1. The stationary pad 74B further incorporates the flat heat-resistant elastic portion 74-2 that contacts the fixing belt 77 at the fixing nip N. Hence, the stationary pad 74B is not bent like a bow by a force exerted by the pressing roller 72 rotating in the rotation direction R3. Additionally, the stationary pad 74B contacting the heating roller 78 in a decreased area, that is, at the contact portions 74-1, decreases friction between the stationary pad 74B and the heating roller 78 sliding over the stationary pad 74B and heat conduction from the heating roller 78 to the stationary pad 74B. Alternatively, the stationary pad 74B may be mounted with the contact portions 74-1 depicted in FIG. 6 or the protrusions 74-5 depicted in FIG. 7.

As shown in FIG. 8C, the stationary pad 74C may have a substantially rectangular shape in cross-section. The stationary pad 74C may be mounted with the contact portions 74-1 depicted in FIG. 6 or the protrusions 74-5 depicted in FIG. 7, the heat-resistant elastic portion 74-2 depicted in FIG. 6, and the entry portion 74-3 and the exit portion 74-4 depicted in FIG. 6.

As shown in FIG. 8D, the stationary pad 74D incorporates the curved contact portions 74-1 that have a curvature corresponding to a curvature of the heating roller 78 and contact the heating roller 78 at upstream and downstream regions outboard from the fixing nip N in the recording medium conveyance direction D1. The stationary pad 74D further incorporates the flat heat-resistant elastic portion 74-2 that contacts the fixing belt 77 at the fixing nip N. Hence, the stationary pad 74D is not bent like a bow by a force exerted by the pressing roller 72 rotating in the rotation direction R3. Additionally, the stationary pad 74D contacting the heating roller 78 in a decreased area, that is, at the contact portions 74-1, decreases friction between the stationary pad 74D and the heating roller 78 sliding over the stationary pad 74D and heat conduction from the heating roller 78 to the stationary pad 74D. The stationary pad 74D may be mounted with the contact portions 74-1 depicted in FIG. 6 or the protrusions 74-5 depicted in FIG. 7.

A detailed description is now given of the fixing belt 77.

The fixing belt 77 having a loop diameter of about 58 mm is constructed of a base layer made of heat-resistant polyimide resin and having a thickness in a range of from about 0.05 mm to about 0.20 mm; and an outer surface release layer coating the base layer. The release layer is constructed of two layers: an inner silicone rubber layer and an outer fluoroplastic layer. The elasticity of the silicone rubber layer causes the outer circumferential surface of the fixing belt 77 to follow surface asperities of the toner image T on the recording medium P. Thus, the fixing belt 77 uniformly applies heat and pressure to the toner image T on the recording medium P. On the other hand, the inner circumferential surface of the fixing belt 77 is treated with processing, a detailed description of which is deferred. According to this exemplary embodiment, the base layer of the fixing belt 77 is made of resin. Alternatively, the base layer may be made of metal (e.g., stainless steel, nickel, and copper), rubber, or the like.

As shown in FIGS. 4 and 5, the anti-slip rollers 70 serving as an anti-slip member are disposed opposite the outer circumferential surface of the fixing belt 77. Springs 71 attached to the anti-slip rollers 70, respectively, press the anti-slip rollers 70 against the heating roller 78 via the fixing belt 77. A detailed description of the anti-slip rollers 70 is deferred.

Figure 9:
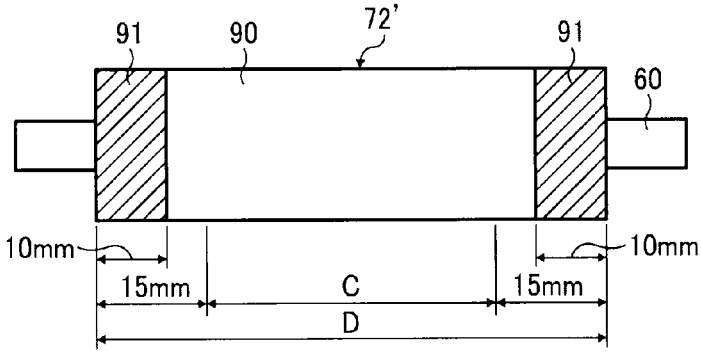
FIG. 9 is a horizontal side view of a pressing roller installable in the fixing device shown in FIG. 4.
Figure 10:
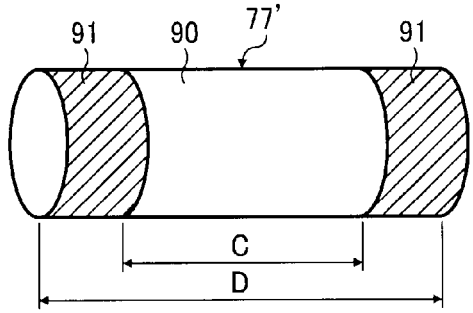
FIG. 10 is a perspective view of a fixing belt installable in the fixing device shown in FIG. 4.

Referring to FIGS. 5, 9, and 10, the following describes a configuration of interfaces CA, CB, CB', CC, and CD between the relevant components described above incorporated in the fixing device 25.

A frictional force F exerted to the interfaces CA, CB, CB', CC, and CD is defined by a following formula (1).

$$F=\mu\times N \tag{1}$$

In the formula (1), μ represents a friction coefficient and N represents a normal force. Accordingly, it is necessary to note the friction coefficient μ and the normal force N to control the frictional force F.

As shown in FIG. 5, the contact span A defines a length of the interface CA in the axial direction of the heating roller 78 where the outer circumferential surface of the heating roller 78 contacts the inner circumferential surface of the fixing belt 77. The contact span B defines a length of the interface CB in the axial direction of the heating roller 78 where an outer circumferential surface of the stationary pad 74 contacts the inner circumferential surface of the fixing belt 77. The contact span B also defines a length of the interface CB' in the axial direction of the heating roller 78 where the outer circumferential surface of the pressing pad 74 contacts the outer circumferential surface of the heating roller 78. The contact span C defines a length of the interface CC in the axial direction of the heating roller 78 where the recording medium P contacts the outer circumferential surface of the fixing belt 77 and the pressing roller 72, that is, the recording medium conveyance region in the axial direction of the heating roller 78 through which the recording medium P is conveyed. A contact span D defines a length of the interface CD in the axial direction of the heating roller 78 where the outer circumferential surface of the pressing roller 72 contacts the outer circumferential surface of the fixing belt 77.

A detailed description is now given of the contact spans A to D.

A length of a body 72*b* of the pressing roller 72, that is, a part of the pressing roller 72 having a greater diameter, in the axial direction of the pressing roller 72 is smaller than a length of the fixing belt 77 in the axial direction of the pressing roller 72. Accordingly, the contact span D of the interface CD where the pressing roller 72 contacts the fixing belt 77 is equivalent to the length of the body 72*b* of the pressing roller 72 in the axial direction thereof. As the pressing lever 82 depicted in FIG. 4 presses the pressing roller 72 in the pressing direction D2, pressure is exerted to the heating roller 78 via the stationary pad 74 throughout the contact span B where the stationary pad 74 contacts the fixing belt 77 and the heating roller 78. Hence, the contact span D is equivalent to the contact span B. With the configuration described above, as the pressing roller 72 rotates, the fixing belt 77 is driven and rotated by a frictional force exerted at the interface CD between the pressing roller 72 and the fixing belt 77.

At the contact span D of the interface CD where the pressing roller 72 contacts the outer circumferential surface of the fixing belt 77, pressure is exerted from the pressing roller 72 to the fixing belt 77 as the normal force N. Similarly, at the contact span B of the interface CB where the stationary pad 74 contacts the inner circumferential surface of the fixing belt 77, the normal force N is exerted. Accordingly, it is necessary to satisfy a following formula (2) to rotate the fixing belt 77 in accordance with rotation of the pressing roller 72. In the following formula (2), $\mu 1$ represents a friction coefficient of the contact span D of the interface CD where the pressing roller 72 contacts the outer circumferential surface of the fixing belt 77 and $\mu 2$ represents a friction coefficient of the contact span B of the interface CB where the stationary pad 74 contacts the inner circumferential surface of the fixing belt 77.

$$\mu 1 > \mu 2 \quad (2)$$

As described above, the outer circumferential surface of the pressing roller 72 and the fixing belt 77 is coated with the release layer that prevents adhesion of toner and paper dust from the recording medium P. Since the release layer is made of a low friction material such as fluoroplastic, the friction coefficient $\mu 1$ of the contact span D of the interface CD where the pressing roller 72 contacts the outer circumferential surface of the fixing belt 77 is small. By contrast, both lateral ends of the pressing roller 72 and the fixing belt 77 in the axial direction thereof where the recording medium P is not conveyed, that is, portions on the outer circumferential surface of the pressing roller 72 and the fixing belt 77 outboard from the contact span C in the axial direction thereof, may be made of a high friction material because it is not necessary to provide the release layer there. In this case, the friction coefficient $\mu 1$ of the contact span D of the interface CD where the pressing roller 72 contacts the outer circumferential surface of the fixing belt 77 may be great.

FIG. 9 illustrates one example of such configuration in which both lateral ends of a pressing roller 72' in an axial direction thereof are made of a high friction material. FIG. 9 is a horizontal side view of the pressing roller 72'. For example, the pressing roller 72', serving as a pressing rotary body, includes a release layer 90 made of fluoroplastic coating a center of the pressing roller 72' in the axial direction thereof; and a base layer 91 made of silicone rubber disposed at both lateral ends of the pressing roller 72' in the axial direction thereof. Specifically, the base layer 91 extending throughout the contact span D is exposed only at both lateral ends of the pressing roller 72' in the axial direction thereof that correspond to lateral end contact spans outboard from the contact span C, that is, the recording medium conveyance region, in the axial direction of the pressing roller 72'. Thus, the recording medium P conveyed through the fixing nip N slidably contacts the release layer 90 of the pressing roller 72' but the outer circumferential surface of the fixing belt 77 frictionally contacts the base layer 91 of the pressing roller 72'. According to this exemplary embodiment, the contact span D where the pressing roller 72' contacts the outer circumferential surface of the fixing belt 77 is by about 15 mm greater than the contact span C corresponding to the recording medium conveyance region where the recording medium P is conveyed at each lateral end of the pressing roller 72' in the axial direction thereof. The base layer 91 is exposed at both lateral end portions on the pressing roller 72' in the axial direction thereof; each of the lateral end portions has a length of about 10 mm in the axial direction of the pressing roller 72' so that the exposed frictional base layer 91 does not contact the recording medium P conveyed through the contact span C of the recording medium conveyance region.

FIG. 10 illustrates another example of the configuration in which both lateral ends of a fixing belt 77' in an axial direction thereof are made of a high friction material. FIG. 10 is a perspective view of the fixing belt 77'. For example, the fixing belt 77' includes the release layer 90, made of fluoroplastic, coating a center of the fixing belt 77' in the axial direction thereof; and the base layer 91, made of silicone rubber, disposed at both lateral ends of the fixing belt 77' in the axial direction thereof. Specifically, the base layer 91 extending throughout the axial direction of the fixing belt 77', that is, the contact span D, is exposed at least at both lateral ends of the fixing belt 77' in the axial direction thereof that correspond to lateral end contact spans outboard from the contact span C, that is, the recording medium conveyance region, in the axial direction of the fixing belt 77'. Thus, the pressing roller 72 depicted in FIG. 5 frictionally contacts the base layer 91 of the fixing belt 77'. In other words, the recording medium P conveyed through the fixing nip N slidably contacts the release layer 90 of the fixing belt 77' but the outer circumferential surface of the pressing roller 72 frictionally contacts the base layer 91 of the fixing belt 77'.

Since silicone rubber has a friction coefficient greater than that of fluoroplastic, the base layer 91 made of silicone rubber is provided at both lateral ends of the pressing roller 72' or the fixing belt 77' as shown in FIGS. 9 and 10 to increase the friction coefficient $\mu 1$ of the contact span D of the interface CD where the pressing roller 72' contacts the outer circumferential surface of the fixing belt 77 depicted in FIG. 5 or the pressing roller 72 depicted in FIG. 5 contacts an outer circumferential surface of the fixing belt 77'. Accordingly, the fixing belt 77 or 77' rotates in accordance with rotation of the pressing roller 72 or 72' precisely by friction therebetween.

As shown in FIG. 5, the contact span B of the interface CB where the stationary pad 74 contacts the inner circumferential surface of the fixing belt 77 is greater than the contact span C of the interface CC where the recording medium P contacts the fixing belt 77 by about 30 mm in total with about 15 mm at each lateral end of the stationary pad 74 in the axial direction of the heating roller 78. As shown in FIG. 5, a lower outer circumferential surface of the stationary pad 74 contacts the inner circumferential surface of the fixing belt 77 and an upper outer circumferential surface of the stationary pad 74 contacts the outer circumferential surface of the heating roller 78. As described above with reference to FIGS. 6 and 7, the stationary pads 74 and 74' may contact the heating roller 78 at a plurality of points within the contact span B depicted in FIG. 5.

As shown in FIG. 5, the stationary pad 74 further includes shafts 74-6 disposed at both lateral ends of the stationary pad 74 that are outboard from the contact span B in the axial direction of the heating roller 78. Each of the shafts 74-6 has a diameter smaller than that of a center portion of the stationary pad 74 disposed in the contact span B so that the shafts 74-6 contact neither the fixing belt 77 nor the heating roller 78. The shafts 74-6 are supported by stoppers 79, respectively. The stoppers 79 are movable in a predetermined amount of several millimeters bidirectionally in a vertical direction in FIG. 5, that is, the pressing direction D2 and a direction counter to the pressing direction D2, only. Similarly, the stationary pad 74 is movable in a predetermined amount bidirectionally in the vertical direction in FIG. 5 only. The stationary pad 74 is pressed against the heating roller 78 by the pressing roller 72.

The stoppers 79 regulate movement of the fixing belt 77 in an axial direction thereof while supporting the stationary pad 74, thus preventing skew of the fixing belt 77. An interface of each of the stoppers 79 that contacts an edge of the fixing belt 77 is coated with grease to minimize a resistance that disturbs rotation of the fixing belt 77.

The interface CB where the stationary pad 74 contacts the inner circumferential surface of the fixing belt 77 and the interface CB' where the stationary pad 74 contacts the heating roller 78 have a configuration that facilitates sliding of the fixing belt 77 over the stationary pad 74 and sliding of the heating roller 78 over the stationary pad 74. For example, the interface CB where the stationary pad 74 contacts the inner circumferential surface of the fixing belt 77 has the configuration that decreases friction between the stationary pad 74 and the fixing belt 77 as described above with reference to FIG. 6. Additionally, the inner circumferential surface of the fixing belt 77 is coated with fluoroplastic having a low friction coefficient. Further, the inner circumferential surface of the fixing belt 77 may be applied with a lubricant such as fluorine grease. The interface CB' where the stationary pad 74 contacts the heating roller 78 also has the configuration that decreases friction between the stationary pad 74 and the heating roller 78 as described above with reference to FIGS. 6 and 7. Additionally, the outer circumferential surface of the heating roller 78 is coated with fluoroplastic having a low friction coefficient. Further, the outer circumferential surface of the heating roller 78 at the interface CB' corresponding to the contact span B may be applied with a lubricant such as fluorine grease.

With the above-described configuration of the fixing device 25, the fixing belt 77 driven and rotated by the pressing roller 72 drives and rotates the heating roller 78. A frictional force F1 with which the fixing belt 77 drives and rotates the heating roller 78 is defined by a following formula (3).

$$F1=\mu 3\times T \tag{3}$$

In the formula (3), μ3 represents a friction coefficient between the inner circumferential surface of the fixing belt 77 and the outer circumferential surface of the heating roller 78 and T represents a tension of the fixing belt 77. Since the heating roller 78 slides over the stationary pad 74, a sliding resistance F2 is defined by a following formula (4).

$$F2=\mu 4\times P \tag{4}$$

In the formula (4), μ4 represents a friction coefficient between the inner circumferential surface of the fixing belt 77 and the outer circumferential surface of the stationary pad 74 and P represents a pressure exerted by the pressing roller 72. Accordingly, it is necessary to satisfy a following formula (5) to cause the fixing belt 77 to drive and rotate the heating roller 78.

$$F1>F2 \tag{5}$$

Since the tension T of the fixing belt 77 is smaller than the pressure P exerted by the pressing roller 72, the friction coefficient μ3 between the inner circumferential surface of the fixing belt 77 and the outer circumferential surface of the heating roller 78 needs to be increased.

However, at the contact span B, the friction coefficient between the inner circumferential surface of the fixing belt 77 and the outer circumferential surface of the heating roller 78 is decreased as described above, which is contradictory to the need to increase the friction coefficient μ3 between the inner circumferential surface of the fixing belt 77 and the outer circumferential surface of the heating roller 78.

To address this contradiction, as shown in FIG. 5, the anti-slip rollers 70 serving as an anti-slip member contact both lateral ends of the outer circumferential surface of the fixing belt 77 in the axial direction of the heating roller 78, thus rotating the heating roller 78 in accordance with rotation of the fixing belt 77 without slippage of the fixing belt 77 and the heating roller 78. For example, when the fixing belt 77 slips, it may not convey the recording medium P passing through the fixing nip N precisely. When the heating roller 78 slips, it may heat the fixing belt 77 ineffectively and may disturb sliding of the fixing belt 77 over the heating roller 78, causing slippage of the fixing belt 77. Specifically, the anti-slip rollers 70 are disposed in contact spans E provided at both lateral ends of the fixing belt 77 in the axial direction of the heating roller 78, respectively. Each of the contact spans E defines a difference in length between the contact span B and the contact span A longer than the contact span B at each lateral end of the fixing belt 77 in the axial direction of the heating roller 78. According to this exemplary embodiment, each of the contact spans E has a length of about 30 mm.

The following describes three examples of the anti-slip member.

A detailed description is now given of a first example of the anti-slip member that supplements the normal force exerted by tension of the fixing belt 77.

For example, as shown in FIGS. 4 and 5, the anti-slip rollers 70 contact the outer circumferential surface of the fixing belt 77 stretched over the heating roller 78 as the springs 71 press the anti-slip rollers 70 against the heating roller 78 via the fixing belt 77. As shown in FIG. 5, a single pair of anti-slip rollers 70 is disposed at both lateral ends, that is, the contact spans E, of the fixing belt 77 in the axial direction thereof and at a single position in a circumferential direction thereof. Alternatively, a plurality of pairs of anti-slip rollers 70 may be disposed in the circumferential direction of the fixing belt 77.

With this configuration of the anti-slip rollers 70, the anti-slip rollers 70 contacting the outer circumferential surface of the fixing belt 77 exert an external force, that is, a bias exerted by the springs 71, to the heating roller 78 via the fixing belt 77 at both lateral ends of the fixing belt 77 in the axial direction thereof, that is, at the contact spans E where the stationary pad 74 contacts neither the fixing belt 77 nor the heating roller 78. Accordingly, the frictional force between the fixing belt 77 and the heating roller 78 is increased in the contact spans E, and thus the fixing belt 77 drives and rotates the heating roller 78 precisely.

The anti-slip rollers 70 may be disposed at any position within the contact span A of the interface CA where the fixing belt 77 contacts the heating roller 78. However, in the contact span B, the friction coefficient between the inner circumferential surface of the fixing belt 77 and the heating roller 78 is relatively small. Hence, the anti-slip rollers 70 may supplement the normal force ineffectively. Moreover, in the contact span C of the interface CC where the recording medium P contacts the fixing belt 77, toner and paper dust may adhere from the recording medium P to the fixing belt 77 and further from the fixing belt 77 to the anti-slip rollers 70. Additionally, heat may be conducted from the fixing belt 77 to the anti-slip rollers 70, degrading heating efficiency of the fixing belt 77 that heats the recording medium P. To address these circumstances, the anti-slip rollers 70 are disposed in the contact spans E.

A detailed description is now given of a second example of the anti-slip member that increases the frictional force between the fixing belt 77 and the heating roller 78.

For example, in the contact spans E outboard from the contact span B in the axial direction of the heating roller 78, the outer circumferential surface of the heating roller 78 and/or the inner circumferential surface of the fixing belt 77 is treated with processing to increase the friction coefficient or mounted with a high friction coefficient member. Accordingly, the frictional force between the fixing belt 77 and the heating roller 78 is increased and thus the fixing belt 77 drives and rotates the heating roller 78 precisely.

Figure 11A:
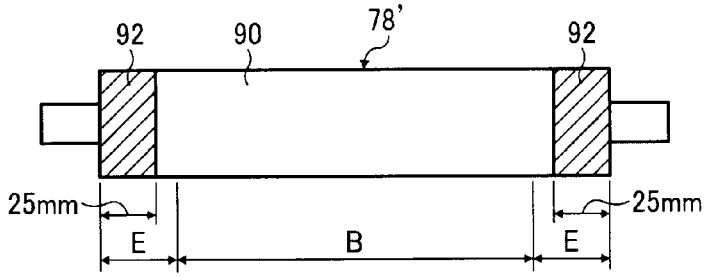
FIG. 11A is a horizontal side view of a heating roller mounted with frictional roughened surface portions as a second example of the anti-slip member.

FIG. 11A is a horizontal side view of a heating roller 78' mounted with frictional roughened surface portions 92 serving as the second example of the anti-slip member. For example, the roughened surface portions 92 produced by sandblasting to have a relatively high friction coefficient are mounted on an outer circumferential surface of the heating roller 78', serving as a heating rotary body, at both lateral ends of the heating roller 78' in an axial direction thereof. Each of the roughened surface portions 92 has a length of about 25 mm in the axial direction of the heating roller 78'. The length of each roughened surface portion 92 is smaller than the length of the contact span E of about 30 mm so that the roughened surface portions 92 do not enter the contact span B where the fixing belt 77 is required to slide over the heating roller 78' smoothly.

Figure 11B:
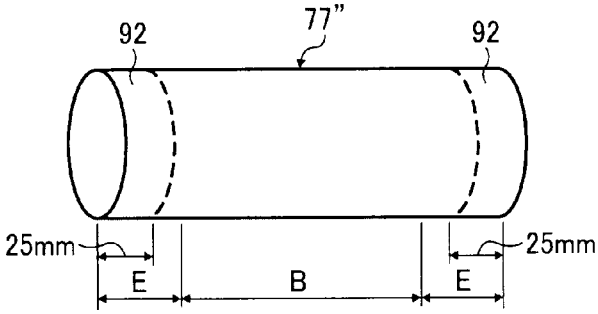
FIG. 11B is a perspective view of a fixing belt mounted with the frictional roughened surface portions as the second example of the anti-slip member.

Alternatively, the inner circumferential surface of the fixing belt 77 may be roughened by sandblasting, for example, instead of mounting the roughened surface portions 92 on the heating roller 78' or in addition to the roughened surface portions 92 mounted on the heating roller 78' as shown in FIG. 11B. FIG. 11B is a perspective view of a fixing belt 77" mounted with the frictional roughened surface portions 92. For example, the roughened surface portions 92 are mounted on an inner circumferential surface of the fixing belt 77" at both lateral ends of the fixing belt 77" in the contact spans E outboard from the contact span B in an axial direction of the fixing belt 77". Alternatively, the inner circumferential surface of the fixing belt 77" may be coated with rubber to increase the friction coefficient between the fixing belt 77" and the heating roller 78.

A detailed description is now given of a third example of the anti-slip member that engages the heating roller 78 with the fixing belt 77.

Figure 12A:
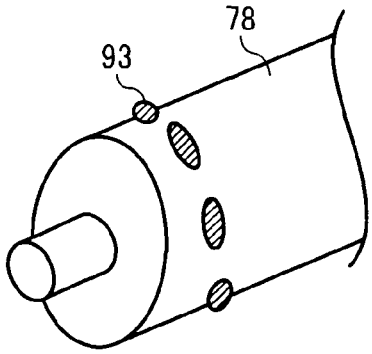
FIG. 12A is a perspective view of a heating roller mounted with protrusions as a third example of the anti-slip member.
Figure 12B:
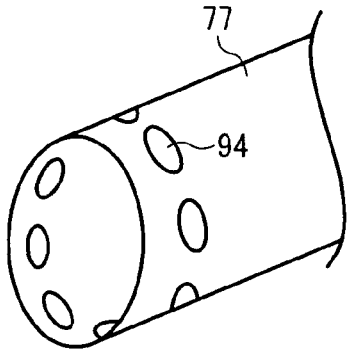
FIG. 12B is a perspective view of a fixing belt mounted with through-holes as the third example of the anti-slip member.

FIG. 12A is a perspective view of the heating roller 78 and protrusions 93 serving as the third example of the anti-slip member. FIG. 12B is a perspective view of the fixing belt 77 and through-holes 94 serving as the third example of the anti-slip member. The third example of the anti-slip member includes the protrusions 93 serving as a first engagement member provided on the heating roller 78 and the through-holes 94 serving as a second engagement member provided in the fixing belt 77 so that the first engagement member provided on the heating roller 78 engages the second engagement member provided in the fixing belt 77. Thus, the third example of the anti-slip member causes the fixing belt 77 to drive and rotate the heating roller 78 by engagement instead of friction used by the first and second examples of the anti-slip member described above. Accordingly, the first and second engagement members cause the fixing belt 77 to drive and rotate the heating roller 78 precisely.

The first and second engagement members of various shapes can be used as the anti-slip member. For example, as shown in FIG. 12A, a plurality of dome-shaped protrusions 93, serving as a first engagement member, is mounted on the outer circumferential surface of the heating roller 78 and aligned in a circumferential direction of the heating roller 78. On the other hand, as shown in FIG. 12B, a plurality of substantially circular through-holes 94, serving as a second engagement member, is produced through the fixing belt 77 and aligned in the circumferential direction of the fixing belt 77. Thus, the protrusions 93 of the heating roller 78 engage the through-holes 94 of the fixing belt 77. A pitch between the adjacent protrusions 93 is identical to a pitch between the adjacent through-holes 94 in the circumferential direction of the heating roller 78 and the fixing belt 77, engaging the protrusions 93 with the through-holes 94 precisely. Thus, the fixing belt 77 drives and rotates the heating roller 78 precisely without slippage.

Alternatively, various combinations of the different anti-slip members as described above may be used. Such combinations can also cause the fixing belt 77 to drive and rotate the heating roller 78 precisely without slippage.

As shown in FIG. 4, the fixing belt 77 having the configuration described above is heated by the heaters 84 via the heating roller 78 while the fixing belt 77 is wound around the heating roller 78. As the heated fixing belt 77 passes through the fixing nip N, the fixing belt 77 applies heat and pressure to the recording medium P conveyed through the fixing nip N, thus fixing the toner image T on the recording medium P.

The following describes advantages of the fixing device 25 according to the exemplary embodiments described above.

As shown in FIG. 4, the heating roller 78 serving as a heating rotary body as well as the stationary pad 74 receives pressure from the pressing roller 72. Accordingly, the pressing roller 72 can exert greater pressure at the fixing nip N to attain the longer fixing nip N in the recording medium conveyance direction D1. Consequently, even if the recording medium P is conveyed through the fixing nip N at higher speed, sufficient heat and pressure can be applied to the toner image T on the recording medium P, resulting in formation of the high quality toner image T without increasing the size and strength of the stationary pad 74. Since the small stationary pad 74 contacts the heating roller 78, the fixing belt 77 looped over the stationary pad 74 and the heating roller 78 has a shorter circumferential length, downsizing the fixing device 25. The shape of the stationary pad 74 that increases the curvature of the fixing belt 77 at the exit of the fixing nip N facilitates separation of the recording medium P from the fixing belt 77. As a result, the recording medium P separates from the fixing belt 77 by itself readily. Since the heating roller 78 contacts the fixing belt 77 while rotating in the rotation direction R2, heat is conducted from the heating roller 78 to the fixing belt 77 effectively.

Although the fixing belt 77 needs to drive and rotate the heating roller 78, the inner circumferential surface of the fixing belt 77 and the outer circumferential surface of the heating roller 78 have a relatively low friction coefficient because they also slidably contact the stationary pad 74 with the decreased sliding resistance between the fixing belt 77 and the stationary pad 74 and between the heating roller 78 and the stationary pad 74. Additionally, the fixing belt 77 contacts the heating roller 78 with small pressure therebetween and therefore friction between the fixing belt 77 and the heating roller 78 is not great enough for the fixing belt 77 to drive and rotate the heating roller 78. To address these problems, as shown in FIG. 5, the interface CA where the fixing belt 77 contacts the heating roller 78, the interface CB where the fixing belt 77 contacts the stationary pad 74, and the interface CD where the pressing roller 72 serving as a pressing rotary body contacts the fixing belt 77 may have the spans different from each other, that is, the contact spans A, B, and D, respectively. Further, the anti-slip member (e.g., the anti-slip rollers 70 depicted in FIG. 5, the roughened surface portions 92 depicted in FIGS. 11A and 11B, and the protrusions 93 and the through-holes 94 depicted in FIGS. 12A and 12B) is disposed in lateral end spans, that is, the contact spans E, provided at both lateral ends of the heating roller 78 serving as a heating rotary body outboard from a center span, that is, the contact span B, where the stationary pad 74 contacts the inner circumferential surface of the fixing belt 77 in the axial direction of the heating roller 78. Accordingly, the fixing belt 77 drives and rotates the heating roller 78 precisely without increasing the sliding resistance between the stationary pad 74 and the fixing belt 77 and between the stationary pad 74 and the heating roller 78. Consequently, as the pressing roller 72 rotates, the pressing roller 72 drives and rotates the fixing belt 77 which in turn drives and rotates the heating roller 78 precisely.

As shown in FIG. 3, the image forming apparatus 100 installed with the fixing device 25 having the above-described configurations provides the advantages described above.

Figure 13:
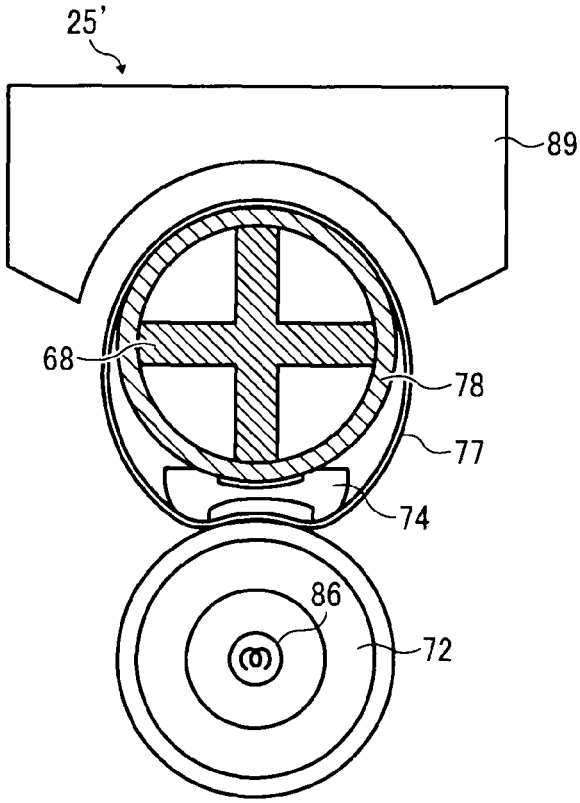
FIG. 13 is a vertical sectional view of a fixing device according to yet another exemplary embodiment of the present invention, which incorporates an induction heater.

The present invention is not limited to the details of the exemplary embodiments described above, and various modifications and improvements are possible. For example, an induction heater 89 may be used as a heater that heats the fixing belt 77 as shown in FIG. 13. FIG. 13 is a vertical sectional view of a fixing device 25' incorporating the induction heater 89. The induction heater 89 is disposed opposite the outer circumferential surface of the heating roller 78 via the fixing belt 77 without contacting the fixing belt 77. The induction heater 89 generates a magnetic flux toward a heat generation layer incorporated in the fixing belt 77 so that the heat generation layer generates heat by the magnetic flux. Alternatively, the induction heater 89 may be disposed inside the hollow heating roller 78 to heat the heating roller 78 which in turn heats the fixing belt 77.

With the induction heater 89 disposed outside the fixing belt 77, no heater is needed inside the heating roller 78. Hence, a rib 68 is disposed opposite the inner circumferential surface of the heating roller 78 to strengthen the heating roller 78 so that the heating roller 78 endures increased pressure from the pressing roller 72.

According to the exemplary embodiments described above, the pressing roller 72 serves as a pressing rotary body that presses against the stationary pad 74 via the fixing belt 77. Alternatively, a pressing belt may serve as a pressing rotary body and a roller disposed inside a loop formed by the pressing belt may press against the stationary pad 74 via the fixing belt 77.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a heating rotary body rotatable in a predetermined direction of rotation;

a heater disposed opposite the heating rotary body to heat the heating rotary body;

a stationary pad contacting an outer circumferential surface of the heating rotary body that slides over the stationary pad in a center span in an axial direction of the heating rotary body;

a flexible endless fixing belt looped over the heating rotary body and the stationary pad;

a pressing rotary body, rotatable in a direction counter to the direction of rotation of the heating rotary body, pressed against the heating rotary body via the fixing belt and the stationary pad interposed between the fixing belt and heating rotary body to form a fixing nip between the pressing rotary body and the fixing belt through which a recording medium bearing a toner image is conveyed, the pressing rotary body to drive and rotate the fixing belt by friction therebetween which in turn drives and rotates the heating rotary body by friction between the fixing belt and the heating rotary body; and an anti-slip member contacting an outer circumferential surface of the fixing belt in a lateral end span in the axial direction of the heating rotary body to press the fixing belt against the heating rotary body to prevent slippage of the heating rotary body and the fixing belt, the lateral end span being at each lateral end of the heating rotary body and outboard from the center span in the axial direction of the heating rotary body.

2. The fixing device according to claim 1, wherein the anti-slip member includes a pair of anti-slip rollers.

3. The fixing device according to claim 1, wherein the anti-slip member includes a plurality of pairs of anti-slip rollers aligned in a circumferential direction of the heating rotary body.

4. The fixing device according to claim 1, wherein the heating rotary body includes a hollow heating roller.

5. The fixing device according to claim 4, wherein the heater includes at least one infrared heater disposed inside the hollow heating roller.

6. The fixing device according to claim 4, wherein the heater includes an induction heater disposed inside the hollow heating roller.

7. The fixing device according to claim 4, wherein the heater includes an induction heater disposed opposite an outer circumferential surface of the hollow heating roller via the fixing belt.

8. The fixing device according to claim 1, wherein the stationary pad includes at least one contact roller to slidably contact the outer circumferential surface of the heating rotary body.

9. The fixing device according to claim 1, wherein the stationary pad includes a plurality of dome-shaped protrusions to contact the outer circumferential surface of the heating rotary body.

10. The fixing device according to claim 1, wherein the stationary pad includes:

an entry roller disposed at an entry to the fixing nip where the recording medium enters the fixing nip, the entry roller to slidably contact an inner circumferential surface of the fixing belt; and an exit roller disposed at an exit of the fixing nip where the recording medium is discharged from the fixing nip, the exit roller to slidably contact the inner circumferential surface of the fixing belt.

11. The fixing device according to claim 10, wherein the stationary pad further includes a heat-resistant elastic portion disposed between the entry roller and the exit roller in a recording medium conveyance direction, the elastic portion to contact the inner circumferential surface of the fixing belt.

12. The fixing device according to claim 1, wherein the pressing rotary body includes:

a release layer, made of fluoroplastic, disposed at a center of the pressing rotary body in an axial direction thereof to slidably contact the recording medium conveyed through the fixing nip; and a frictional base layer, made of silicone rubber, disposed at both lateral ends of the pressing rotary body outboard from the center of the pressing rotary body in the axial direction thereof to frictionally contact the outer circumferential surface of the fixing belt.

13. The fixing device according to claim 1, wherein the fixing belt includes:

a release layer, made of fluoroplastic, disposed at a center of the fixing belt in an axial direction thereof to slidably contact the recording medium conveyed through the fixing nip; and a frictional base layer, made of silicone rubber, disposed at both lateral ends of the fixing belt outboard from the center of the fixing belt in the axial direction thereof to frictionally contact an outer circumferential surface of the pressing rotary body.

14. A fixing device comprising:

a heating rotary body rotatable in a predetermined direction of rotation;

a heater disposed opposite the heating rotary body to heat the heating rotary body;

a stationary pad contacting an outer circumferential surface of the heating rotary body that slides over the stationary pad in a center span in an axial direction of the heating rotary body;

a flexible endless fixing belt looped over the heating rotary body and the stationary pad;

a pressing rotary body, rotatable in a direction counter to the direction of rotation of the heating rotary body, pressed against the heating rotary body via the fixing belt and the stationary pad interposed between the fixing belt and heating rotary body to form a fixing nip between the pressing rotary body and the fixing belt through which a recording medium bearing a toner image is conveyed, the pressing rotary body to drive and rotate the fixing belt by friction therebetween which in turn drives and rotates the heating rotary body by friction between the fixing belt and the heating rotary body; and a frictional roughened surface portion mounted on at least one of an inner circumferential surface of the fixing belt and the outer circumferential surface of the heating rotary body in a lateral end span in the axial direction of the heating rotary body to prevent slippage of the heating rotary body and the fixing belt, the lateral end span being at each lateral end of the heating rotary body and outboard from the center span in the axial direction of the heating rotary body.

15. The fixing device according to claim 14, wherein the frictional roughened surface portion is processed by sandblasting.

16. A fixing device comprising:

a heating rotary body rotatable in a predetermined direction of rotation;

a heater disposed opposite the heating rotary body to heat the heating rotary body;

a stationary pad contacting an outer circumferential surface of the heating rotary body that slides over the stationary pad in a center span in an axial direction of the heating rotary body;

a flexible endless fixing belt looped over the heating rotary body and the stationary pad;

a pressing rotary body, rotatable in a direction counter to the direction of rotation of the heating rotary body, pressed against the heating rotary body via the fixing belt and the stationary pad interposed between the fixing belt and heating rotary body to form a fixing nip between the pressing rotary body and the fixing belt through which a recording medium bearing a toner image is conveyed, the pressing rotary body to drive and rotate the fixing belt by friction therebetween which in turn drives and rotates the heating rotary body by friction between the fixing belt and the heating rotary body;

a first engagement member mounted on the heating rotary body; and a second engagement member mounted on the fixing belt to engage the first engagement member of the heating rotary body to prevent slippage of the heating rotary body and the fixing belt, the first engagement member and the second engagement member being in a lateral end span provided at each lateral end of the heating rotary body and outboard from the center span in the axial direction of the heating rotary body.

17. The fixing device according to claim 16, wherein the first engagement member includes a plurality of protrusions aligned on the outer circumferential surface of the heating rotary body in a circumferential direction of the heating rotary body and the second engagement member includes a plurality of through-holes produced through the fixing belt and aligned in a circumferential direction of the fixing belt.

18. An image forming apparatus comprising the fixing device according to claim 1.

* * * * *